US006048187A

United States Patent [19]

Hamasaki et al.

[11] Patent Number: 6,048,187

[45] Date of Patent: Apr. 11, 2000

[54] GEAR PUMP

[75] Inventors: Yoshiaki Hamasaki, Kashiba; Toshio Iida, Kashiwara, both of Japan

[73] Assignee: Koyo Seiko Co., Ltd., Osaka, Japan

[21] Appl. No.: 09/104,142

[22] Filed: Jun. 24, 1998

[30] Foreign Application Priority Data

Jul. 16, 1997 [JP] Japan ..... 9-191631

[51] Int. Cl.[7] ..... F01C 1/18

[52] U.S. Cl. ..... 418/206.1; 418/1; 418/76; 417/366; 417/410.4

[58] Field of Search ..... 418/206.1, 1, 76; 417/366, 410.4

[56] References Cited

U.S. PATENT DOCUMENTS

| | | | |
|---|---|---|---|
| 4,431,356 | 2/1984 | Lassota | 418/1 |
| 4,431,387 | 2/1984 | Lassota | 418/1 |
| 4,525,126 | 6/1985 | Laumont . | |
| 5,725,362 | 3/1998 | Zepp | 417/366 |

FOREIGN PATENT DOCUMENTS

| | | | |
|---|---|---|---|
| 593732 | 3/1960 | Canada | 417/410.4 |
| 3-15592 | 3/1991 | Japan . | |
| 403124990 | 5/1991 | Japan | 417/410.4 |
| 405141378 | 6/1993 | Japan | 417/410.4 |
| 405202862 | 8/1993 | Japan | 418/76 |

*Primary Examiner*—Thomas Denion
*Assistant Examiner*—Thai-Ba Trieu
*Attorney, Agent, or Firm*—Darby & Darby

[57] ABSTRACT

A gear pump is provided with a drive gear rotated via a drive shaft; a slave gear; a gear housing containing a gear chamber housing these gears therein; and a pump housing composed of a cylindrical housing main body with a bottom which contains the gear housing for serving as a low pressurized chamber, the inside of which communicates with the gear chamber, and an opening being defined thereon, and a covering member for closing the opening, wherein an eccentric pitted portion being eccentric with respect to the axis of the drive shaft is defined on the covering member, and the fluid return port is allowed to face to the eccentric pitted portion to function the eccentric pitted portion as a return fluid passage for return fluid, whereby it is possible to reduce a size of the gear pump without accompanying any cavitation.

10 Claims, 9 Drawing Sheets

GEAR PUMP

BACKGROUND OF THE INVENTION

The present invention relates to a gear pump provided with a drive gear and a slave gear meshed with each other.

A gear pump is described, for example, in Japanese Patent Publication No. 15592/1991 (Hei 3-15592) wherein this conventional gear pump is, as shown in FIG. 1, provided with a drive gear B rotating via a drive shaft A; a slave gear C meshed with the drive gear B; a gear housing E provided with a gear chamber D containing these drive and slave gears B and C; and a pump housing G containing the gear housing E and functioning as a low pressurized chamber F the inside of which communicates with said gear chamber D.

The pump housing G is composed of a housing main body G1 defining an opening on one side of the housing in the axial direction of the drive shaft A and a detachable covering member G2 for closing the opening.

A gear pump as described above is arranged in such that accumulated in the above described low pressurized chamber F is an operating fluid such as oil, the operating fluid contained in the low pressurized chamber F is sucked into the gear chamber D to be a pressurized, the pressurized fluid is delivered to the outside of the pump housing G, and then the fluid is to be returned to the low pressurized chamber F as a return fluid from a fluid return port (not shown).

In the gear pump constituted as described above, return fluid is directly returned to the low pressurized chamber F. Since the return fluid is returned to the low pressurized chamber F at a certain velocity, there has been a problem that an operating fluid contained in the low pressurized chamber F is agitated by the return fluid and thus air bubbles produced by the agitation are sucked into the gear chamber D, resulting cavitation.

Furthermore, the problem of such cavitation may be solved by such an arrangement that a volume of the low pressurized chamber F is permitted to increase, thereby permitting the operating fluid in the low pressurized chamber F to make difficult to be agitated by the return fluid.

However, it results in such a problem that the pump housing G, in its turn, the overall gear pump becomes large-sized, on the other hand.

BRIEF SUMMARY OF THE INVENTION

The present invention has been made with the aim of solving the above problems, and it is one object of the present invention to provide a gear pump which is constituted of a pump housing formed cylindrically around the axis of a drive shaft which rotates a drive gear; and an eccentric structure of a gear chamber wherein a slave gear is disposed eccentric with respect to the axis of said drive shaft. An eccentric pitted portion being decentered with respect to the axis of said drive shafts deposed to the pump housing, whereby said eccentric pitted portion is used as a fluid returning for return fluid. As a result, the overall size of the gear pump can be compact without generating cavitation.

The gear pump of the present invention is characterized in that it comprises a drive gear rotated by an electric motor via a drive shaft; a slave gear meshed with said drive gear; a gear housing containing a gear chamber housing these drive and slave gears therein; and a pump housing in which said gear housing is housed for serving as a low pressurized chamber the inside of which communicates with said gear chamber, onto said pump housing being defined a fluid return port which opens to said low pressurized chamber in which said pump housing is composed of a housing main body at least either side of which along the longitudinal direction of said drive shaft an opening is provided, and a covering member for closing said opening, wherein an eccentric pitted portion being eccentric with respect to axis of said drive shaft is provided on either of said covering member and an opposite wall of said housing main body opposed to said covering member next to said low pressurized chamber, and said fluid return port is allowed to face to said eccentric pitted porion.

Therefore, since the eccentric pitted portion is defined on either of the covering member of the pump housing formed cylindrically centering around the axis of the drive shaft rotating the drive gear and the opposite wall faced to the covering member, thereby facing the fluid return port to the eccentric pitted portion, so that it is possible to serve the eccentric pitted portion as a fluid returning passage for return fluid returned from the fluid return port.

Furthermore, the return fluid returned from the fluid return port is not sucked immediately into the gear chamber, but the return fluid is allowed to pass through the eccentric pitted portion functioning as the fluid returning passage, whereby velocity of the return fluid can be reduced. As a result, the cavitation can be eliminated without increasing a volume of a low pressurized chamber and an overall size of the gear pump can be reduced.

The other gear pump of the present invention is characterized in that said eccentric pitted portion is provided on said cover.

Therefore, since the eccentric pitted portion is detachably provided on the covering member, the eccentric pitted portion can be formed simply, so that more reduction in cost is possible.

The gear pump of the present invention is characterized in that a fitting portion to be fit into said housing main body is formed on said covering member, and said eccentric pitted portion is provided on the outer circumference of said fitting portion.

Therefore, a gap provided between the inner surface of the housing main body and the eccentric pitted portion may be served as a fluid returning passage for the return fluid, so that a wider fluid returning passage can be provided, resulting in less cavitation in response to the width of the fluid returning passage.

The other gear pump of the present invention is characterized in that said covering member is provided with a partition plate for dividing said eccentric pitted portion from said low pressurized chamber, and a communicating portion for communicating said eccentric pitted portion with the low pressurized chamber is provided on said partition plate.

Therefore, velocity of the overall return fluid returned from a fluid return port can be effectively reduced within the eccentric pitted portion, so that only the return fluid thus slowed down may be returned to the low pressurized chamber from the communicating portion, resulting in no cavitation as well as in reduction of an overall size of the gear pump.

The above and further objects and features of the invention will more fully be apparent from the following detailed description with accompanying drawings.

BRIEF DESCRIPTION OF THE SEVERAL VIEWS OF THE DRAWINGS

FIG. 6 is a sectional view taken along the line N—N of

FIGS. 7, 7A, 7B, and 7C, sometimes referred to collectively as are views each showing a partition plate wherein FIG. 7A is a side view; FIG. 7B is a sectional view in the vertical section; and FIG. 7C is a bottom view;

DETAILED DESCRIPTION OF THE INVENTION

The present invention will be described in detail herein after in conjunction with the accompanying drawings.

Figure 1:
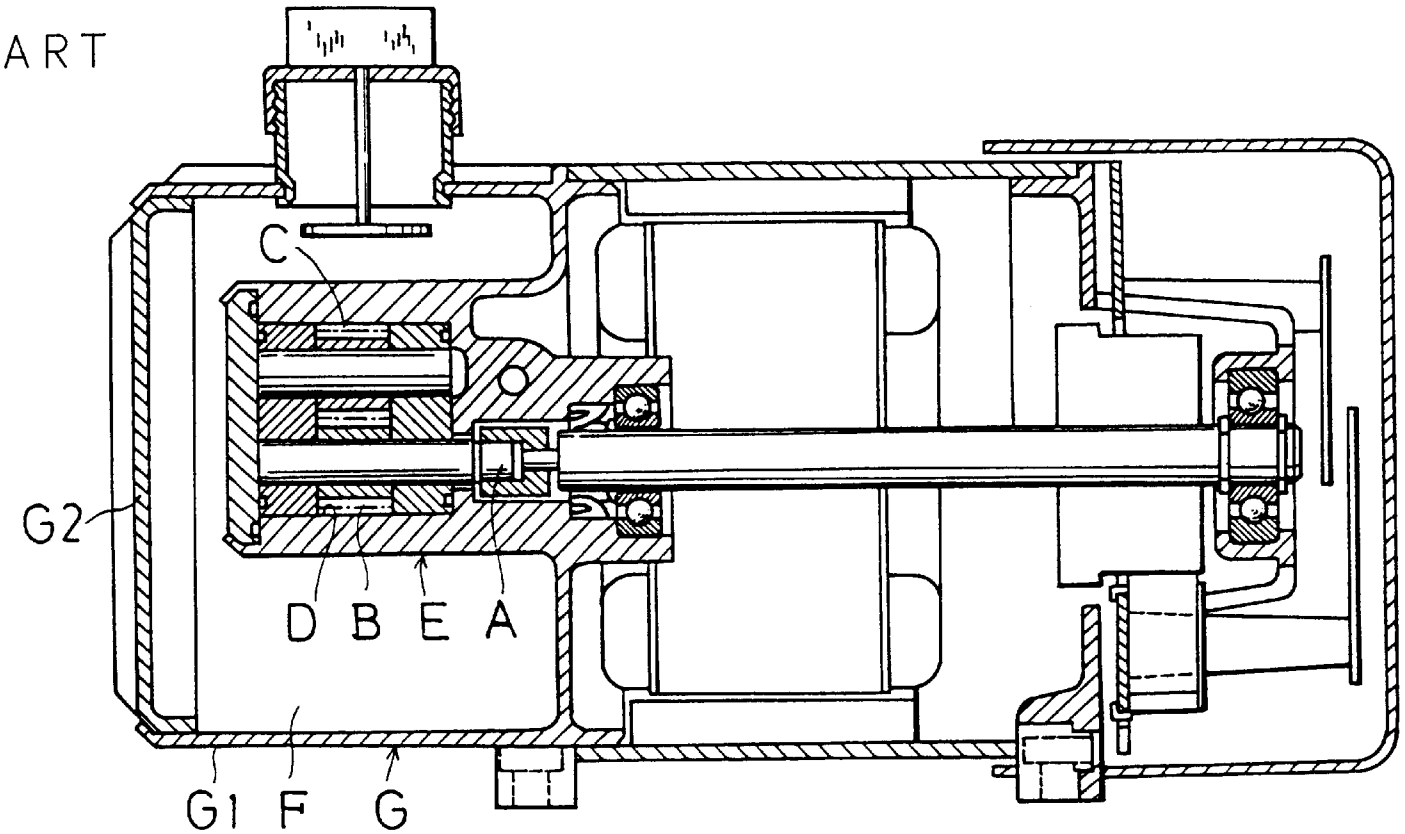
FIG. 1 PRIOR ART
FIG. 1 is a side view, in the longitudinal direction, showing a conventional gear pump.
Figure 2:
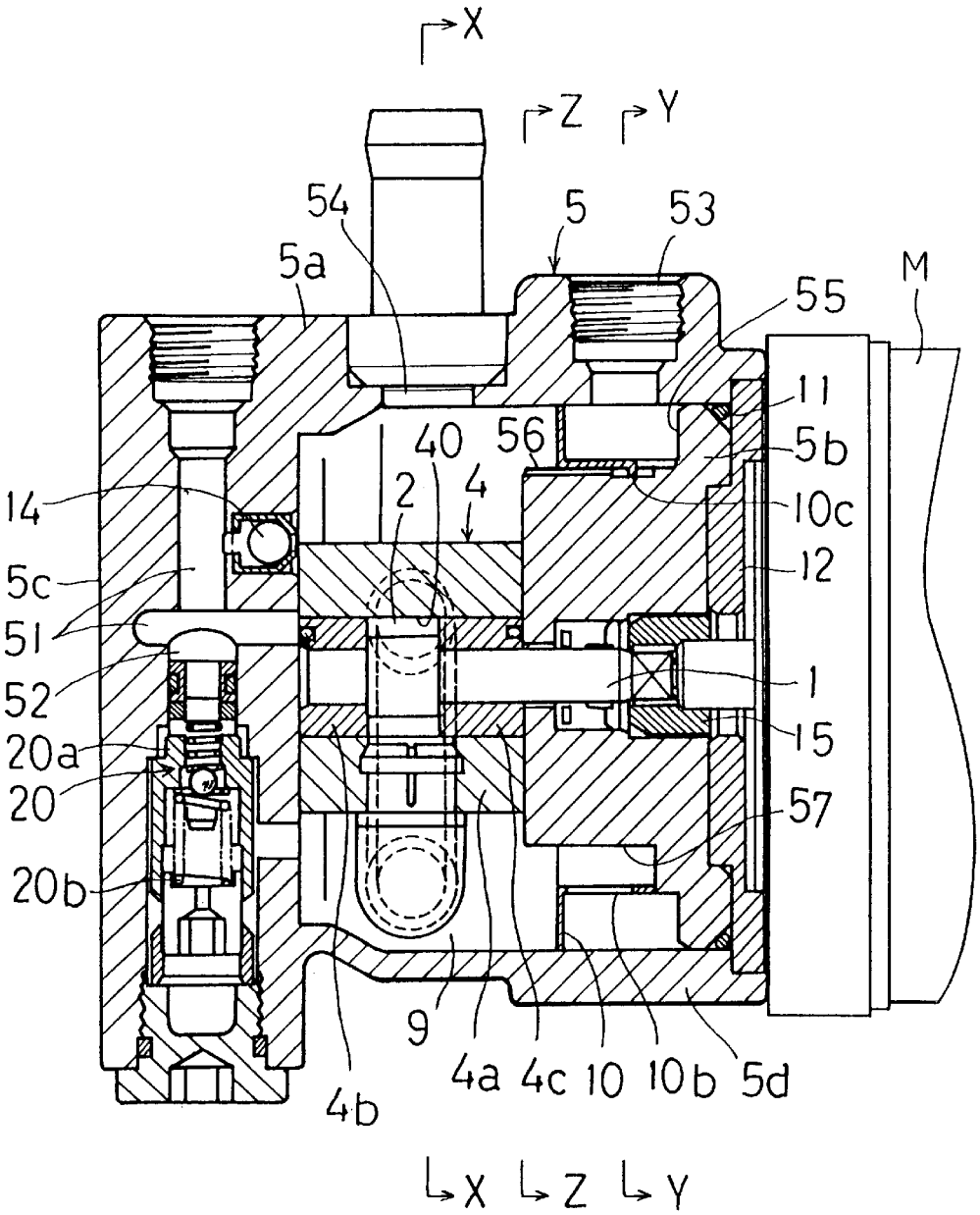
FIG. 2 is a front elevational view showing the gear pump according to the present invention.
Figure 3:
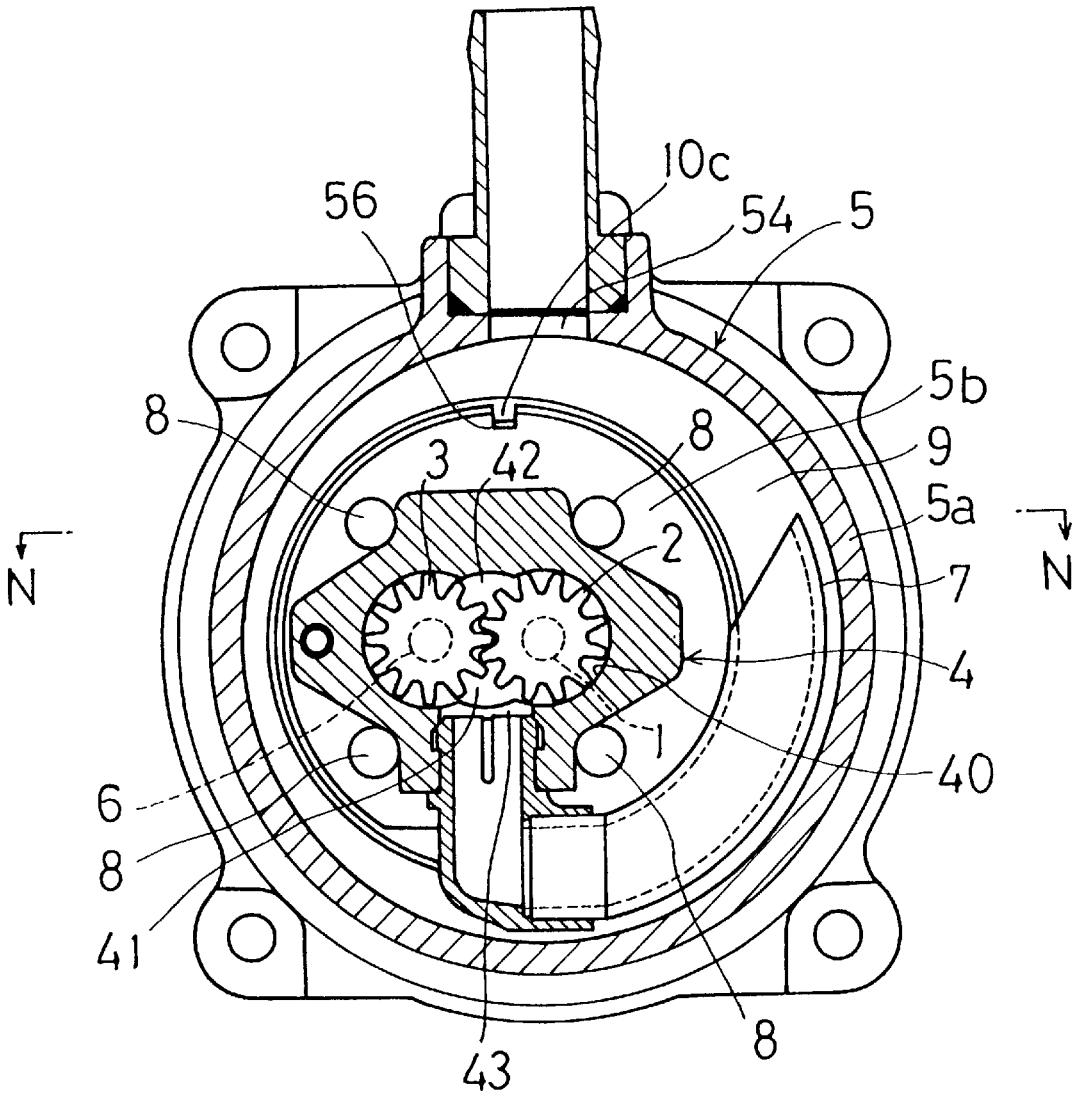
FIG. 3 is a sectional view taken along the line X—X of FIG. 2.
Figure 4:
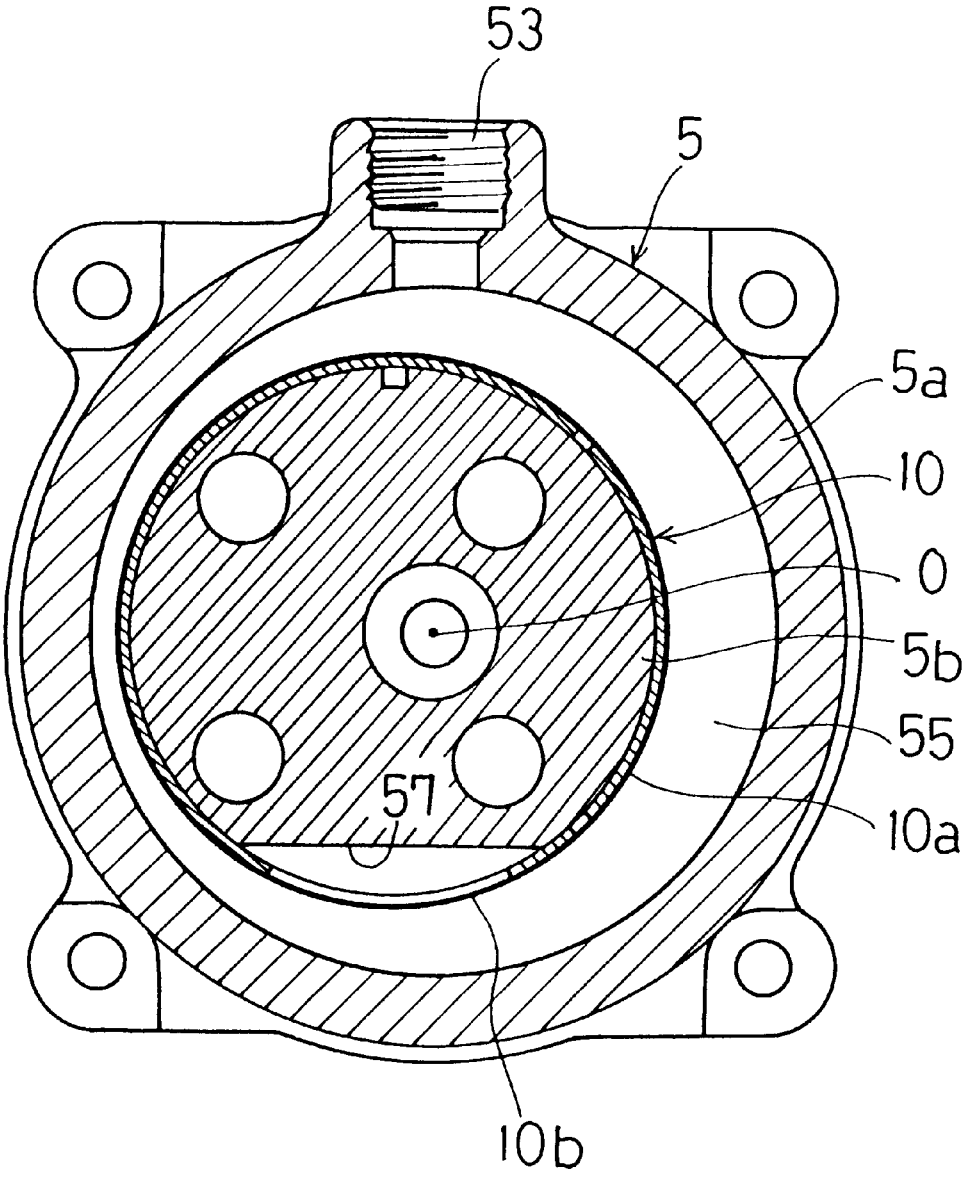
FIG. 4 is a sectional view taken along the line Y—Y of FIG. 2.
Figure 5:
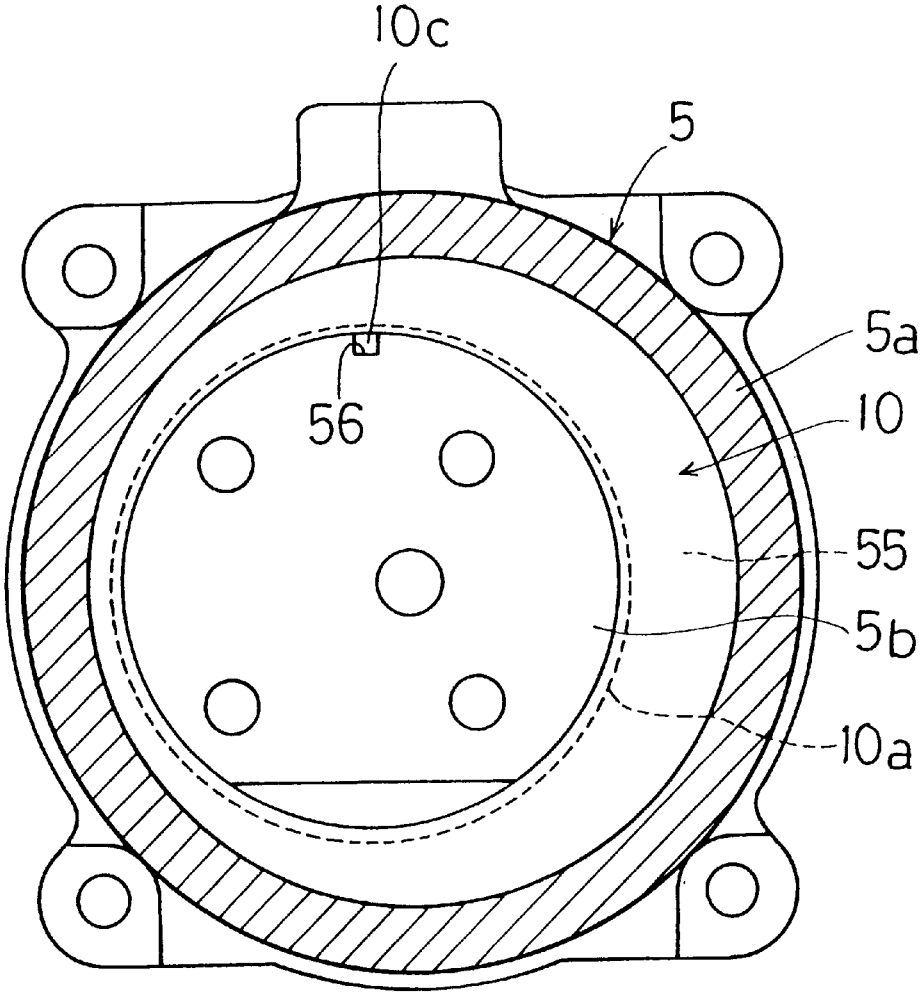
FIG. 5 is a sectional view taken along the line Z—Z of FIG. 2.
Figure 6:
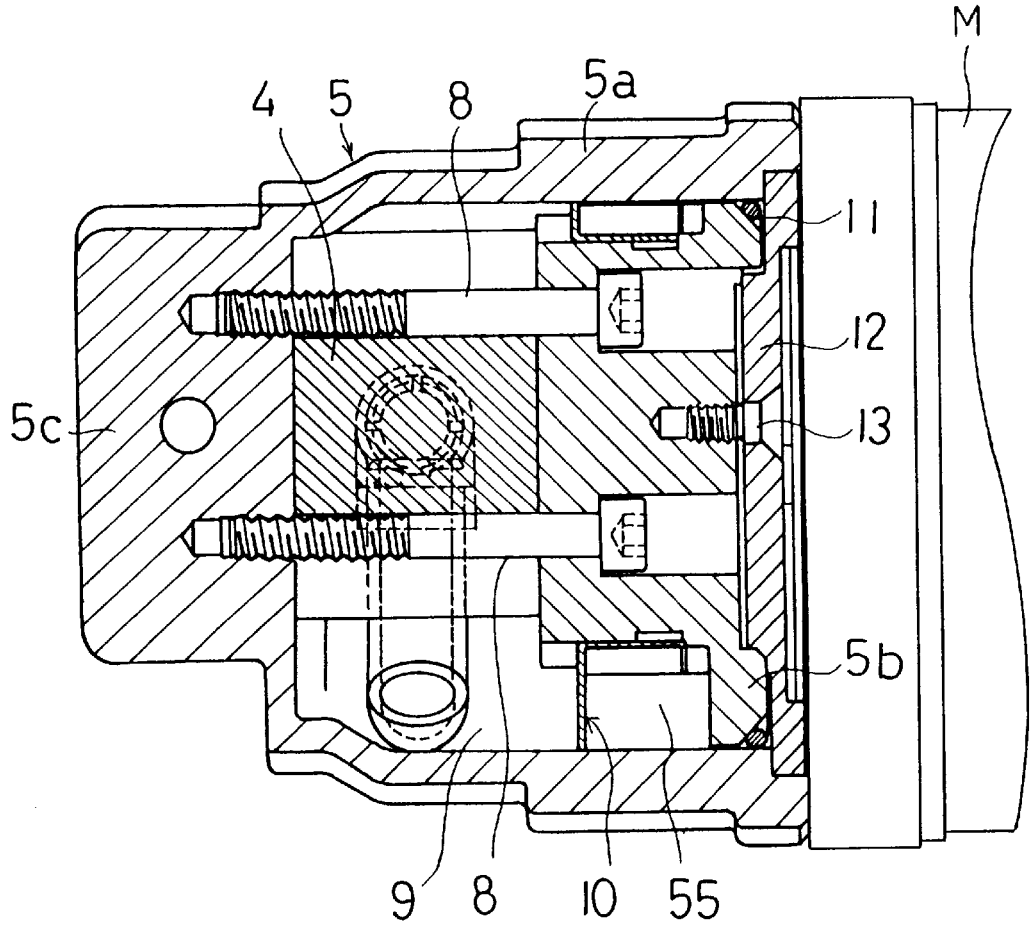
Figure 7A:
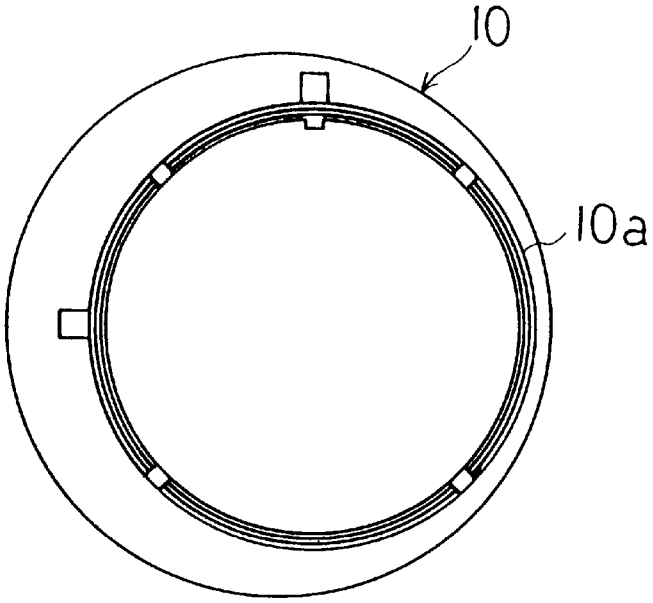
Figure 7B:
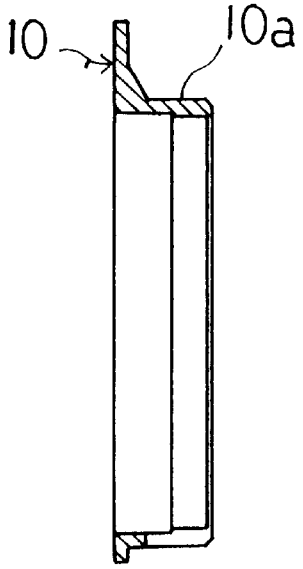
Figure 7C:
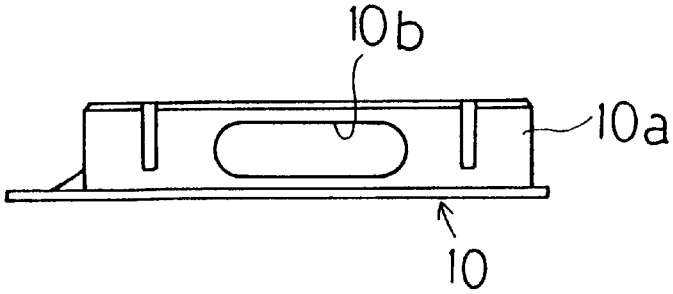

FIG. 2 is a front elevational view showing the gear pump according to the present invention, FIG. 3 is a sectional view taken along the line X—X of FIG. 2, FIG. 4 is a sectional view taken along the line Y—Y of FIG. 2, FIG. 5 is a sectional view taken along the line Z—Z of FIG. 2, and FIG. 6 is a sectional view taken along the line N—N of FIG. 3, respectively.

The gear pump shown in FIGS. 2 to 6, inclusive, is provided with a drive gear 2 rotated by an electric motor M provided next to the gear pump via a drive shaft 1; a slave gear 3 meshed with the drive gear 2; a gear housing 4 having a gear chamber 40 containing these drive and slave gears 2 and 3; and a pump housing 5 containing the gear housing 4 and rotatably supporting the drive shaft 1.

The gear housing 4 contains is provided with a cylindrical body portion 4*a* containing an elliptical gear chamber 40 communicating with each other in which the gear chamber 40 contains the drive and slave gears 2 and 3, and a pair of side plates 4*b* and 4*c* for closing the both side of openings.

The drive and slave gears 2 and 3 being meshed with each other are rotatably supported by two pairs of bearing holes bored on the side plates 4*b* and 4*c*, respectively, via the drive shaft 1 and a slave shaft 6 being parallel to the drive shaft 1, whereby it is arranged in such that the gear chamber 40 partitioned with the meshed portion is served for a suction chamber 41 and a discharge chamber 42, respectively, an operating fluid sucked in the suction chamber 41 is received by gaps provided between gear teeth of the drive and slave gears 2 and 3 with holding the fluid at the inner circumferential surface of the gear chamber 40, thereby effecting pumping action to deliver the fluid to the discharge chamber 42.

On a certain position being the underside of the body portion 4*a*, a suction port 43 being opened towards the suction chamber 41 is provided. Furthermore, a discharge port (not shown) being opened towards the discharge chamber 42 is provided on the side plate 4*b* being one of the side plates 4*b* and 4*c*. A rubber made muffling tube 7 extending upwards along the circumferential surface of a low pressurized chamber which will be described hereinafter is connected to the suction port 43, whereby noise generated by returning pressurized fluid confined between a pair of meshed teeth of the drive and slave gears 2 and 3 to the suction chamber 41 can be muffled.

The pump housing 5 is provided with a cylindrical housing main body 5*a* with a bottom having an opening port in either side in the longitudinal direction of the drive shaft 2 and a disk-shaped covering member 5*b* for closing the opening and which is fit in the housing main body 5*a*. The gear housing 4 is fixed between the covering member 5*b* and the opposite wall 5*c* opposed to the covering member 5*b* and secured by four clamp screws 8, 8, . . . , the circumference of the gear housing 4 is served for an annular low pressurized chamber 9, and an end of the drive shaft 1 is inserted in an axial hole bored in the central portion of the covering member 5*b* to support the same.

A cylindrical portion 5*d* of the housing main body 5*a* is formed in a cylindrical shape centering around the center of the axis 0 of the drive shaft 1, while the covering member 5*b* is formed in a disk shape centering also around the center of the axis 0. Furthermore, the opposite wall 5*c* of the housing main body 5*a* is provided with a substantially L-shaped discharge passage 51 communicated with the discharge port of the gear housing 4, and a relief passage 52 opened towards the discharge passage 51. The cylindrical portion 5*d* is provided with a fluid return port 53 opened towards the inside of the cylindrical portion 5*c* in the vicinity of the opening thereof, and a fluid charging port 54 opened towards the inside of the cylindrical portion 5*d* between the fluid return port 53 and the discharge passage 51.

Moreover, to the outer circumference of a fitting portion of the covering member 5*b* is formed an annular eccentric pitted portion 55 being decentered with respect to the center of the axis 0 of the drive shaft 1, the fluid return port 53 is faced to the eccentric pitted portion 55 at a certain position thereof, whereby the eccentric pitted portion 55 is served for a fluid returning passage for the fluid returned into the housing main body 5*a* from the fluid return port 53, so that the fluid flows from the upper portion to the lower portion of the passage along the eccentric pitted portion 55. A whirl-stop groove 56 extending in the thickness direction of the eccentric pitted portion 55 is provided thereon at a certain position being held in the upper side thereof, while a flat concaved portion 57 which is more concaved than that of the eccentric pitted portion 55 is provided on the eccentric pitted portion 55 at another position being held in the lower side thereof.

An annular partition plate 10 for partitioning the eccentric pitted portion 55 from the low pressurized chamber 9 is disposed on the eccentric pitted portion 55 of the covering member 5*b*.

The partition plate 10 is formed in an annular shape, as shown in FIG. 5, having an outer circumferential surface corresponding to the inner circumferential surface of the housing main body 5*a* and an eccentric inner circumferential surface corresponding to the outer circumferential surface of the eccentric pitted portion 55. Around the inner circumferential surface of the eccentric pitted portion 55, a fitting cylindrical portion 10*a* is mounted, a communicating hole 10*b* faced on the concaved portion 57 is provided at a certain position being held in the underside of the fitting cylindrical portion 10*a* to communicate the eccentric pitted portion 55 with the low pressurized chamber 9, while a whirl-stop piece

10*c* to be engaged with the whirl-stop groove 56 is protrusively formed at another position being held in the upper side of the fitting cylindrical section 10*a*, whereby a position of the partition plate 10 to be embedded therein is decided.

It is arranged in such that the aforesaid relief passage 52 communicates with the low pressurized chamber 9 via a relief valve 20 contained in the relief passage 52, whereby such operating fluid which has been relieved can be returned to the low pressurized chamber 9.

The relief valve 20 is formed in a cartridge type which is provided with a valve body 20*a* for closing the relief passage 52 and a valve spring 20*b* energizing the valve body 20*a*. The relief valve 20 is detachably inserted into the relief passage 52 and maintained, so that the valve body 20*a* is adapted to be opened in case of overpressure of the discharge passage 51.

Moreover, the covering member 5*b* is chamfered at the outer circumferential corner portion being opposite to the eccentric pitted portion 55, an annular sealing member 11 is disposed in the chamfered portion, so that a gap defined between the housing main body 5*a* and the covering member 5*b* is sealed. A circular end plate 12 is fixed to the outside of the covering member 5*b* by means of two set screws 13. Reference numeral 14 in FIG. 2 designates a check valve for letting a pressurized fluid flow directory from the low pressurized chamber 9 to discharge passage 51 in the case when the electric motor for rotating the drive shaft 1 is stopped due to troubles and the like under such a state where the pressurized fluid is supplied to an operating chamber on either side of a liquid-operated apparatus.

In the gear pump constituted as described above, for example, a flange formed protrusively on a side end portion of the covering member 5*b* of the pump housing 5 is attached to the electric motor M by four attaching screws, and a motor shaft of the electric motor M is interlockingly connected with the drive shaft 1 via a drive joint 15, so that the drive gear 2 is rotated via the drive shaft 1. Furthermore, an operating fluid stored in a subsidiary tank (not shown) drops to the low pressurized chamber 9 of the pump housing 4 from a liquid charging port 54 due to dead weight of the operating fluid until the low pressurized chamber 9 is filled up.

Based on the rotation of the drive gear 2, the slave gear 3 meshed therewith is rotated. With the rotation of these drive and slave gears 2 and 3, the operating fluid in the low pressurized chamber 9 is sucked in the suction chamber 41 from the muffling tube 7, a pressurized liquid is produced in every occasions where respective liquid chambers sectioned by each spacing of respective teeth and the inner circumferential surface of the gear chamber 40 are opened for the discharge chamber 42, the pressurized liquid thus produced is supplied to the discharge passage 51 via the discharge chamber 42, and the pressurized liquid is fed to an operation chamber on either side of a liquid-operated apparatus from the discharge passage 51, while the operating fluid is returned to the fluid return port 53 from an operation chamber on the other side of the liquid-operated apparatus.

Since the fluid return port 53 is faced to the eccentric pitted portion 55, pressure of the return fluid returned to the fluid return port 53 is reduced during which the return fluid flows along the return fluid passage of the eccentric pitted portion 55, and such return fluid can be returned to the low pressurized chamber 9 from the communicating hole 10*b*.

For this reason, agitation of operating fluid in the low pressurized chamber 9 by means of return fluid can be effectively prevented without increasing a volume of the low pressurized chamber 9, so that cavitation can positively be prevented.

Moreover, the eccentric pitted portion 55 which is decentered with respect to the center of the axis 0 of the drive shaft 1 is defined on the covering number 5*b* by utilizing the pump housing 5 formed in a cylindrical shape centering around the center of the axis 0 of the drive shaft 1, and the eccentric structure of the gear section wherein the slave gear 3 is disposed eccentrically with respect to the center of the axis 0 of the drive shaft 1. As a result, a return fluid passage may be formed without increasing a size of the pump housing 5, whereby an overall size of the gear pump can be reduced.

Besides, since the covering member 5*b* which is detachable to the housing main body 5*a* is provided with the eccentric pitted portion 55, the eccentric pitted portion 55 can be easily defined by molding or machining, resulting in reduction of cost.

Figure 8:
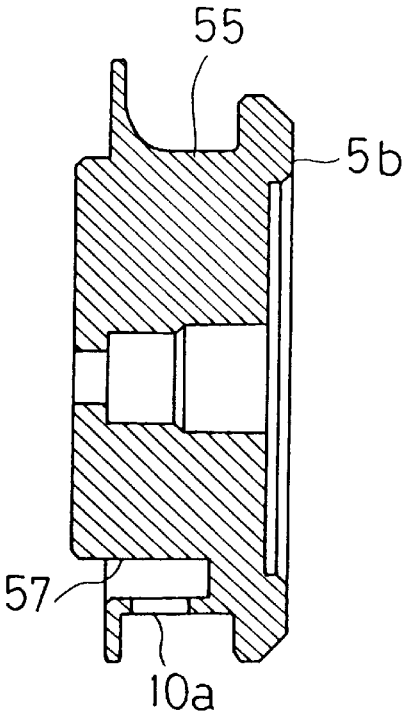
FIG. 8 is a sectional view showing an essential part of the gear pump of another embodiment according to the present invention.

While the covering member 5*b* has been provided with the partition plate 10 to partition the eccentric pitted portion 55 from the low pressurized chamber 9 in the embodiment which has been described above, other modifications such as that wherein the eccentric pitted portion 55 is disposed on the midway in the thickness direction of the outer circumferential surface of the covering member 5*b* as shown in FIG. 8 may be adopted without accompanying the partition plate 10.

Figure 9:
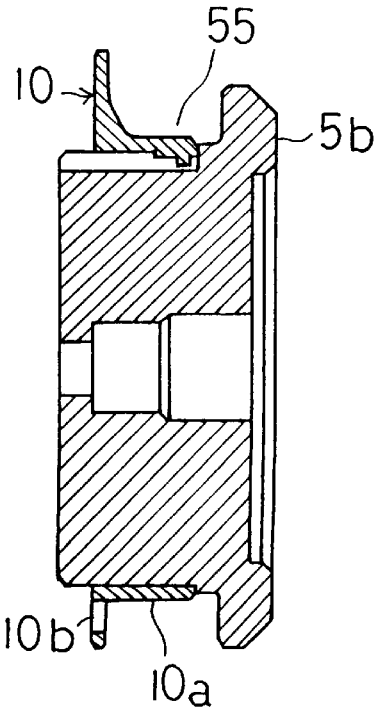
FIG. 9 is a sectional view showing an essential part of the gear pump of a still another embodiment according to the present invention.

Furthermore, in case of providing the partition plate 10, the communicating hole 10*b* communicating the eccentric pitted portion 55 with the low pressurized chamber 9 may be defined on a disklike section as shown in FIG. 9 in place of the fitting cylindrical section 10*a*.

Figure 10:
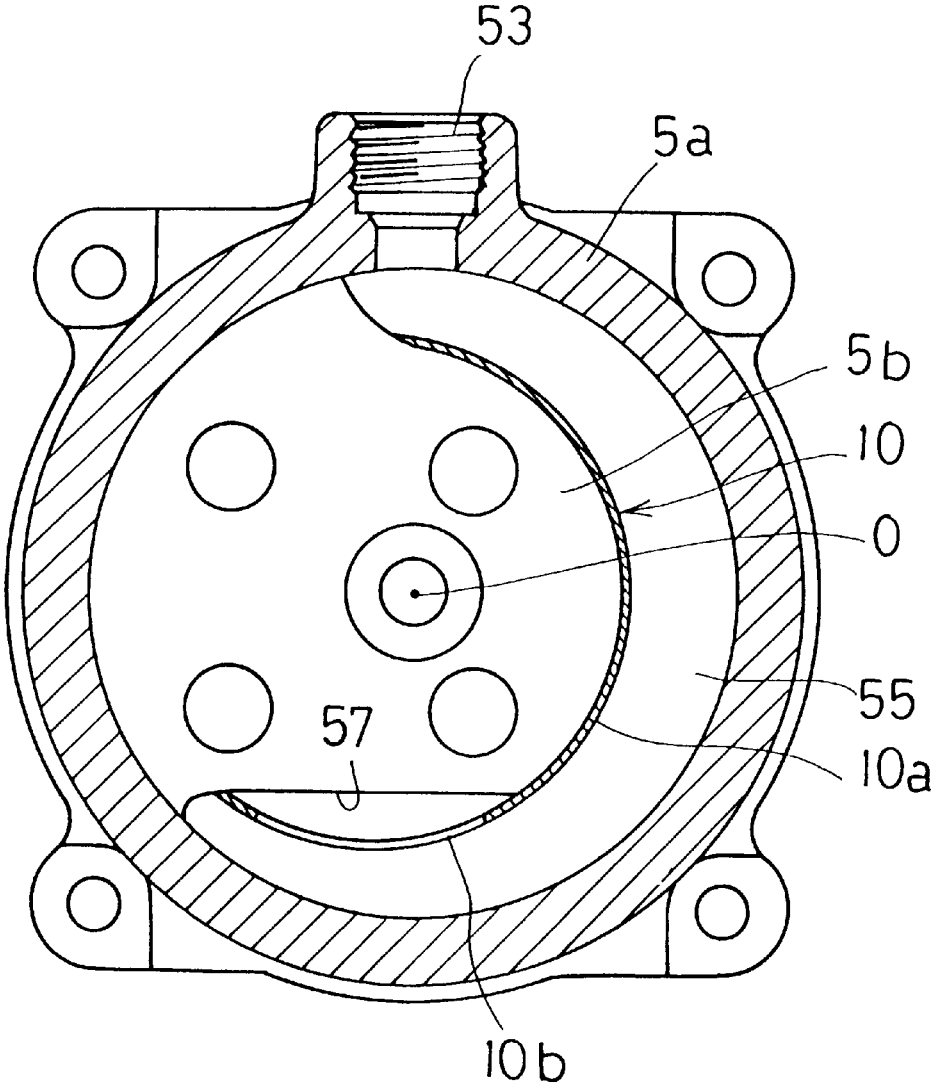
FIG. 10 is a sectional view showing an essential part of the gear pump of an yet further embodiment according to the present invention.

In the above described embodiment, although the annular eccentric pitted portion 55 has been formed, other modifications such as that wherein the eccentric pitted portion 55 is formed in a circular arc-shaped which is decentered with respect to the axis of the drive shaft 1 as shown in FIG. 10 may be applied. In this case, the partition plate 10 shall be formed in a shape corresponding to that of the circular arc-shaped eccentric pitted portion.

While the pump housing 5 provided with the cylindrical housing main body 5*a* with a bottom wherein an opening is provided on either side of the drive shaft 1 in the direction of the axis thereof, and the covering member 5*b* for closing the opening has been used, and the eccentric pitted portion 55 has been defined on the covering member 5*b* in the above described embodiments, such eccentric pitted portion 55 may be defined on the opposite wall section 5*c* of the housing main body 5*a*.

In this case, the discharge passage 51 and the relief passage 52 are disposed on, for example, the covering member 5*b*. Furthermore, the pump housing 5 shall be constituted in such that it is provided with a cylindrical housing main body 5*a* the opposite ends of which are opened, and a pair of covering member 5*b* and 5*b* for closing opening of the opposite ends of the housing main body 5*a*, respectively, and further the eccentric pitted portion 55 may be defined on either of the covering members 5*b* and 5*b*.

The gear pump according to the present invention is essentially applied for a pump used for power steering apparatus, automatic gearing apparatus and the like which is actuated by hydraulic pressure and which is provided for generating operation hydraulic pressure in an auxiliary equipment in order to assist driving operation. However, a site to be employed in such gear pump is not limited.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A gear pump, comprising:

a drive shaft;

a drive gear rotated via said drive shaft;

a slave gear meshed with said drive gear;

a gear housing containing a gear chamber housing said drive and slave gears therein; and a pump housing containing said gear housing and a low pressurized chamber which communicates with said gear chamber, said pump housing having:

a fluid return port being opened to said low pressurized chamber;

a housing main body onto which is provided an opening in at least either side along the longitudinal direction of said drive shaft;

a covering member for closing said opening; and an eccentric pitted portion being eccentric with respect to the center of the axis of said drive shaft on either of said covering member and the wall of said housing main body opposed to said covering member via said low pressurized chamber, and placed so as to face to said fluid return port.

2. The gear pump according to claim 1, wherein said eccentric pitted portion is provided on said covering member.

3. The gear pump according to claim 2, wherein said covering member having:

a fitting portion, fitted into said housing main body, and provided with said eccentric pitted portion on the outer circumference thereof.

4. The gear pump according to claim 2, wherein said covering member having:

a partition plate for partitioning between said eccentric pitted portion and said low pressurized chamber; and a communicating portion for communicating said eccentric pitted portion with said low pressurized chamber provided to said partition plate.

5. The gear pump according to claim 3, wherein said covering member having:

a partition plate for partitioning between said eccentric pitted portion and said low pressurized chamber; and a communicating portion for communicating said eccentric pitted portion with said low pressurized chamber provided to said partition plate.

6. A gear pump, comprising:

an electric motor;

a drive shaft connected to said electric motor;

a drive gear rotated via said drive shaft;

a slave gear meshed with said drive gear;

a gear housing containing a gear chamber housing said drive and slave gears therein; and a pump housing containing said gear housing and a low pressurized chamber which communicates with said gear chamber, said pump housing having:

a fluid return port being opened to said low pressurized chamber;

a housing main body onto which is provided an opening in at least either side along the longitudinal direction of said drive shaft;

a covering member for closing said opening; and an eccentric pitted portion being eccentric with respect to the center of the axis of said drive shaft on either of said covering member and the wall of said housing main body opposed to said covering member via said low pressurized chamber, and placed so as to face to said fluid return port.

7. The gear pump according to claim 6, wherein said eccentric pitted portion is provided on said covering member.

8. The gear pump according to claim 7, wherein said covering member having:

a fitting portion, fitted into said housing main body, and provided with said eccentric pitted portion on the outer circumference thereof.

9. The gear pump according to claim 7, wherein said covering member having:

a partition plate for partitioning between said eccentric pitted portion and said low pressurized chamber; and a communicating portion for communicating said eccentric pitted portion with said low pressurized chamber provided to said partition plate.

10. The gear pump according to claim 8, wherein said covering member having:

a partition plate for partitioning between said eccentric pitted portion and said low pressurized chamber; and a communicating portion for communicating said eccentric pitted portion with said low pressurized chamber provided to said partition plate.

* * * * *